US009447785B2

(12) United States Patent
Ito et al.

(10) Patent No.: US 9,447,785 B2
(45) Date of Patent: Sep. 20, 2016

(54) ROTARY ACTUATOR

(71) Applicant: NABTESCO CORPORATION, Tokyo (JP)

(72) Inventors: Koji Ito, Gifu (JP); Takashi Koizumi, Gifu (JP)

(73) Assignee: NABTESCO CORPORATION, Tokyo (JP)

( * ) Notice: Subject to any disclaimer, the term of this patent is extended or adjusted under 35 U.S.C. 154(b) by 854 days.

(21) Appl. No.: 13/848,591

(22) Filed: Mar. 21, 2013

(65) Prior Publication Data

US 2013/0247754 A1 Sep. 26, 2013

(30) Foreign Application Priority Data

Mar. 26, 2012 (JP) ..... 2012-069290

(51) Int. Cl.

| | |
|---|---|
| ***F15B 15/12*** | (2006.01) |
| ***F04B 53/00*** | (2006.01) |
| ***F01C 1/063*** | (2006.01) |
| ***F01C 21/00*** | (2006.01) |

(52) U.S. Cl.

CPC ..... *F04B 53/00* (2013.01); *F01C 1/063* (2013.01); *F01C 21/005* (2013.01); *F15B 15/125* (2013.01)

(58) Field of Classification Search

CPC ..... F04B 53/00; F01C 9/002; F01C 11/002; F01C 21/08; F01C 21/005; F01C 1/063; F04C 9/002; F15B 15/125

See application file for complete search history.

(56) References Cited

U.S. PATENT DOCUMENTS 3,938,480 A * 2/1976 Yanda ..... F01B 13/04 123/43 B
5,601,165 A 2/1997 Oppitz et al.

FOREIGN PATENT DOCUMENTS

DE 871557 C * 3/1953 ..... F15B 15/125
FR 967717 A * 11/1950 ..... F15B 15/125
GB 634607 A * 3/1950 ..... F15B 15/125

OTHER PUBLICATIONS

The extended European search report issued by the European Patent Office on May 27, 2015, which corresponds to European Patent Application No. 13161110.5-1608 and is related to U.S. Appl. No. 13/848,591.

* cited by examiner

*Primary Examiner* — Thomas E Lazo
*Assistant Examiner* — Abiy Teka
(74) *Attorney, Agent, or Firm* — Studebaker & Brackett PC

(57) ABSTRACT

An output shaft and arms are installed inside a cylinder. Pistons that are formed in an arc shape and rotatably connected to the arms slide and are displaced in the circumferential direction of the cylinder inside the cylinder. Inside the cylinder, a first pressure chamber on the arm side and second pressure chambers on the piston head portion side are provided. Third pressure chambers are provided on both sides of the cylinder. A pressure medium is supplied to one of the first pressure chamber and the second pressure chamber and discharged from the other, and the output shaft pivots in a rotational direction. When the pressure medium is supplied to the second pressure chambers, the pressure medium is also supplied to the third pressure chambers.

7 Claims, 7 Drawing Sheets

ROTARY ACTUATOR

CROSS-REFERENCE TO RELATED APPLICATION

This application claims priority to Japanese Patent Application No. 2012-69290. The entire disclosure of Japanese Patent Application No. 2012-69290 is hereby incorporated herein by reference.

BACKGROUND OF THE INVENTION

1. Field of the Invention

The present invention relates to rotary actuators that output a driving torque as a result of output shafts pivoting in a rotational direction due to an action of a pressure medium.

2. Description of Related Art

A rotary actuator having such a configuration as one disclosed in U.S. Pat. No. 5,601,165 is known as one of the rotary actuators that output a driving torque as a result of output shafts pivoting in a rotational direction due to an action of a pressure fluid serving as a pressure medium.

In the rotary actuator disclosed in U.S. Pat. No. 5,601,165, ribs are provided inside a cylinder as an integral unit, and vanes are provided to an output shaft that is rotatably installed inside the cylinder. Both ends of the cylinder are provided with end caps. The ribs and the inner wall surface of the cylinder, as well as the vanes and the outer wall surface of the output shaft form pressure chambers. Adjacent pressure chambers are alternately supplied with a pressure fluid, the output shaft thereby pivots in a rotational direction due to an action of the pressure fluid, and, as a result, a driving torque is output.

In the above rotary actuator, seals that are formed in a plate shape or in a block shape are inserted in grooves provided on the ribs and the vanes. The seals inserted in the ribs are pressed against the outer wall surface of the output shaft, and the seals inserted in the vanes are pressed against the inner wall surface of the cylinder. Thus, the adjacent pressure chambers are sealed against each other. The pressure chambers are also sealed against each other by means of gaskets between the end caps and the output shaft, as well as between the end caps and the vanes.

SUMMARY OF THE INVENTION

In a conventional general rotary actuator such as the one disclosed in U.S. Pat. No. 5,601,165, a rotary sliding portion between the rotary output shaft and the ribs provided on the cylinder is sealed by the seals inserted in the ribs. A rotary sliding portion between the vanes provided on the rotary output shaft and the cylinder is also sealed by the seals inserted into the vanes. Furthermore, rotary sliding portions between the rotary output shaft and the end caps and between the vane and the end caps are also sealed by the gaskets.

Unfortunately, it is difficult to suppress leakage of the pressure fluid in the rotary sliding portions by means of the seals. In the conventional rotary actuators such as the one disclosed in U.S. Pat. No. 5,601,165, leakage occurs from the seals or the gaskets in many cases under the current circumstances. Therefore, the pressure fluid often leaks inside the rotary actuator. Moreover, the conventional rotary actuators have a structure in which the seals that are formed in a plate shape or in a block shape are inserted in the grooves on the ribs or the vanes, and therefore, the problem of leakage between the grooves and the seals also arises. Furthermore, since each seal inserted in the groove has corner sections, it is particularly difficult to maintain close contact to the surface relative to which the seal slides, in these corner sections and in the vicinity thereof, which makes it difficult to suppress leakage. Therefore, the pressure fluid leaks more often within the rotary actuator.

In addition, the conventional rotary actuators need high-pressure rotary seals that are used in the rotary sliding portions and pressed with high pressure against the surface relative to which the seals slide. Such seals are therefore different from statically used seals or those in a linear sliding mode in which a contact portion that is in contact with a surface relative to which the seals slide is relatively displaced and uniformly slides along a predetermined linear direction or curved direction with respect to the surface relative to which the seals slide, and another problem arises of significantly shorter duration of the seals during which sealing characteristics intended by the design can be maintained. For this reason, a rotary actuator whose structure does not need the high-pressure rotary seals, or is able to significantly reduce the number of the high-pressure rotary seals, is desired to be realized.

In light of the foregoing situation, it is an object of the present invention to provide a rotary actuator capable of reducing internal leakage of the pressure medium, and whose structure does not need the high-pressure rotary seals, or is able to significantly reduce the number of the high-pressure rotary seals.

To achieve the above-stated object, a rotary actuator according to a first feature of the present invention is a rotary actuator that outputs a driving torque as a result of an output shaft pivoting in a rotational direction due to an action of a pressure medium, comprising: a case; a cylinder that is installed within the case and internally has a hollow space; an output shaft that is rotatably supported with respect to the case, has an axial direction parallel to an axial direction of the cylinder, and is installed in the hollow space; an arm that is integrated with, or fixed to, the output shaft, and extends in a radial direction of the cylinder; and a piston that has a portion extending in an arc, and is installed inside the cylinder and supported so as to be able to slide and be displaced with respect to the cylinder along a circumferential direction of the cylinder, wherein the cylinder has a plurality of cylinder blocks formed in a divided state, and the cylinder is integrally assembled by the plurality of cylinder blocks being put together along the axial direction of the cylinder; inside the cylinder, a first pressure chamber in which the output shaft and the arm are housed and a second pressure chamber that is defined by the cylinder and the piston and to which a piston head portion provided at one end of the piston is opposed are provided; the cylinder is provided with a piston chamber that houses the piston supported so as to be able to slide and be displaced with respect to the cylinder and that defines the second pressure chamber, between cylinder blocks that are adjacent to each other in the axial direction of the cylinder; the piston is provided with a connecting portion that is rotatably connected to the arm at an end that is opposite to the one end; inside the case, a third pressure chamber that is in communication with the second pressure chamber is provided on at least one of both sides of the cylinder in the axial direction of the cylinder; as a result of the pressure medium being supplied to one of the first pressure chamber and the second pressure chamber and discharged from the other of the first pressure chamber and the second pressure chamber, the arm is displaced in the circumferential direction of the cylinder, and the output shaft pivots in the rotational direction; and when the pressure medium is supplied to the second pressure chamber, the pressure medium is also supplied to the third pressure chamber, and the cylinder is biased due to the action of the pressure medium.

With this configuration, inside the cylinder installed within the case, the pressure medium is supplied to one of the first pressure chamber and the second pressure chamber and discharged from the other, and the piston thereby slides and is displaced in the circumferential direction of the cylinder. As a result of the arm to which the piston is rotatably connected being driven by the piston, the output shaft pivots together with the arm in the rotational direction. Thus, the driving torque of the rotary actuator is output. As described above, with the rotary actuator having the above configuration, the first pressure chamber on the connecting portion side of the piston that slides with respect to the cylinder and the second pressure chamber on the piston head portion side are defined inside the cylinder. Thus, such a structure including pressure chambers defined by an output shaft, vanes, a cylinder, ribs, and end caps, as the structure of the conventional rotary actuators, is not necessary. In other words, the rotary actuator having the above configuration does not need rotary sliding portions between the output shaft and the ribs provided on the cylinder, between the cylinder and the vanes provided on the rotary output shaft, and between the rotary output shaft with the vanes and the end caps. As a result, with the above configuration, internal leakage of the pressure medium within the rotary actuator can be reduced. In addition, the rotary actuator having the above configuration does not need, or is able to significantly reduce the number of, the high-pressure rotary seals that are used in the rotary sliding portions and pressed with high pressure against the surface relative to which the seals slide.

Consequently, with the above configuration, it is possible to provide the rotary actuator capable of reducing internal leakage of the pressure medium, and realizing a structure that does not need the high-pressure rotary seals, or is able to significantly reduce the number of the high-pressure rotary seals.

Furthermore, in the above configuration, the piston that drives, via the arm, the output shaft to rotate is rotatably connected to the arm. Therefore, even if an external load acts on the output shaft, the arm can be prevented from separating from the piston. Consequently, in the case where a servo control mechanism is built for control of the rotational position of the output shaft driven by the piston that is displaced due to supply and discharge of the pressure medium to/from the first and second pressure chambers, reduction in the responsiveness of this servo mechanism can be suppressed. In other words, even if the responsiveness of the above servo mechanism is increased, momentary incapability of the above-mentioned rotational position control is prevented.

Furthermore, with the above configuration, the cylinder is assembled by the plurality of cylinder blocks being put together in the axial direction of the cylinder, and the piston chamber is defined between adjacent cylinder blocks. Therefore, when the piston chamber is formed, a semicircular groove is formed on each cylinder block, and these grooves are combined to constitute the piston chamber. It is thus possible to readily form the piston chamber for housing the piston that slides and is displaced in the circumferential direction of the cylinder, and to readily manufacture the cylinder.

Furthermore, with the above configuration, when the pressure medium is supplied to the second pressure chamber, the pressure medium is also supplied to the third pressure chamber that is provided on at least one of both sides in the axial direction of the cylinder, and the cylinder is biased. Therefore, a biasing force generated due to an action of the pressure medium supplied to the third pressure chamber acts to bias adjacent cylinder blocks in the axial direction of the cylinder, against an action of the pressure medium supplied to the second pressure chamber. In other words, due to the biasing force generated due to the action of the pressure medium supplied to the third pressure chamber, the plurality of cylinder blocks are biased in a direction in which the cylinder blocks are pressed against one another in the axial direction of the cylinder. Consequently, even if the case is elastically deformed in the axial direction due to the action of the supplied pressure medium, close contact between adjacent cylinder blocks that define the piston chamber can be readily maintained.

A rotary actuator according to a second feature of the present invention is the rotary actuator according to the first feature, wherein an area of a cross-section of the third pressure chamber that is perpendicular to the axial direction of the cylinder is larger than, or the same as, an area of a cross-section of the second pressure chamber that is perpendicular to the axial direction of the cylinder and at a position of a fitting face of cylinder blocks that are adjacent to each other.

With this configuration, regarding the cross-sectional area in the axial direction of the cylinder, the cross-sectional area of the third pressure chamber is set to be larger than or equal to that of the second pressure chamber. Therefore, in the axial direction of the cylinder, the magnitude of the biasing force generated due to the action of the pressure medium supplied to the third pressure chamber can be set to be larger than or equal to the magnitude of the biasing force generated due to the action of the pressure medium supplied to the second pressure chamber. Consequently, close contact between adjacent cylinder blocks that define the piston chamber can be reliably maintained.

A rotary actuator according to a third feature of the present invention is the rotary actuator of the first or second feature, further comprising a pressure chamber defining member that is installed inside the case on at least one of both sides of the cylinder in the axial direction of the cylinder, defines the third pressure chamber between the pressure chamber defining member and the cylinder, and is fixed to the case in a state of being in close contact with an inner circumference of the case.

With this configuration, the third pressure chamber can be readily configured with a simple structure by installing the pressure chamber defining member on at least one of both sides in the axial direction of the cylinder inside the case.

A rotary actuator according to a fourth feature of the present invention is the rotary actuator according to any one of the first to third features, wherein a plurality of the pistons are provided, and the plurality of pistons are arranged in line along an axial direction of the output shaft.

With this configuration, the output shaft is driven via the arm by the plurality of pistons that are installed in line along the axial direction of the output shaft. Therefore, it is possible to output a larger amount of driving torque with a compact structure, without increasing the dimension in the radial direction of the cylinder.

A rotary actuator according to a fifth feature of the present invention is the rotary actuator according to any one of the first to fourth features, wherein a plurality of the arms are provided so as to extend in the radial direction of the cylinder from a plurality of positions on the output shaft.

With this configuration, the arms are provided so as to radially extend from the plurality of positions on the output shaft. Therefore, in the case where the plurality of pistons for driving, via the arms, the output shaft to rotate are installed, the design associated with the installation positions thereof can be made more freely. Note that the arms may be provided so as to extend in the radial direction of the cylinder from the plurality of positions in the axial direction of the output shaft, for example. Furthermore, the arms may be provided so as to extend in radial direction of the cylinder from the plurality of positions on the output shaft, forming different angles in the circumferential direction of the cylinder.

A rotary actuator according to a sixth feature of the present invention is the rotary actuator of the fifth feature, wherein the plurality of arms are provided to extend in the radial direction of the cylinder along the same plane that is perpendicular to the axial direction of the output shaft, a piston unit is provided that is constituted by the plurality of pistons installed so as to extend in the circumferential direction of the cylinder along the same plane, and the pistons in the piston unit are rotatably connected to the respective arms.

With this configuration, the output shaft can be driven to rotate by the plurality of pistons in the piston unit that are installed along the same plane perpendicular to the axial direction of the output shaft. Therefore, it is possible to output a lager amount of driving torque while preventing the rotary actuator from becoming longer in the axial direction of the cylinder, and also preventing the rotary actuator from becoming larger in the radial direction of the cylinder. For example, in the case where the piston unit is constituted by two pistons, it is possible to double the output of the rotary actuator without increasing its length in the axial direction and the size in the radial direction.

A rotary actuator according to a seventh feature of the present invention is the rotary actuator according to the sixth feature, wherein a plurality of the piston units are provided, and the plurality of piston units are arranged in line along the axial direction of the output shaft.

With this configuration, the output shaft is driven via the arms by the plurality of piston units installed in line along the axial direction of the output shaft. Therefore, it is possible to output a further large amount of driving torque with a compact structure, without increasing the dimension in the radial direction of the cylinder.

It should be appreciated that the above and other objects, features and advantages of the present invention will become apparent from the following description taken in conjunction with the accompanying drawings.

DETAILED DESCRIPTION OF THE INVENTION

Hereinafter, an embodiment for implementing the present invention will be described with reference to the drawings. Note that the present invention can be widely applied to rotary actuators that output a driving torque as a result of output shafts thereof pivoting in a rotational direction due to an action of a pressure medium.

Rotary Actuator Configuration

Figure 1:
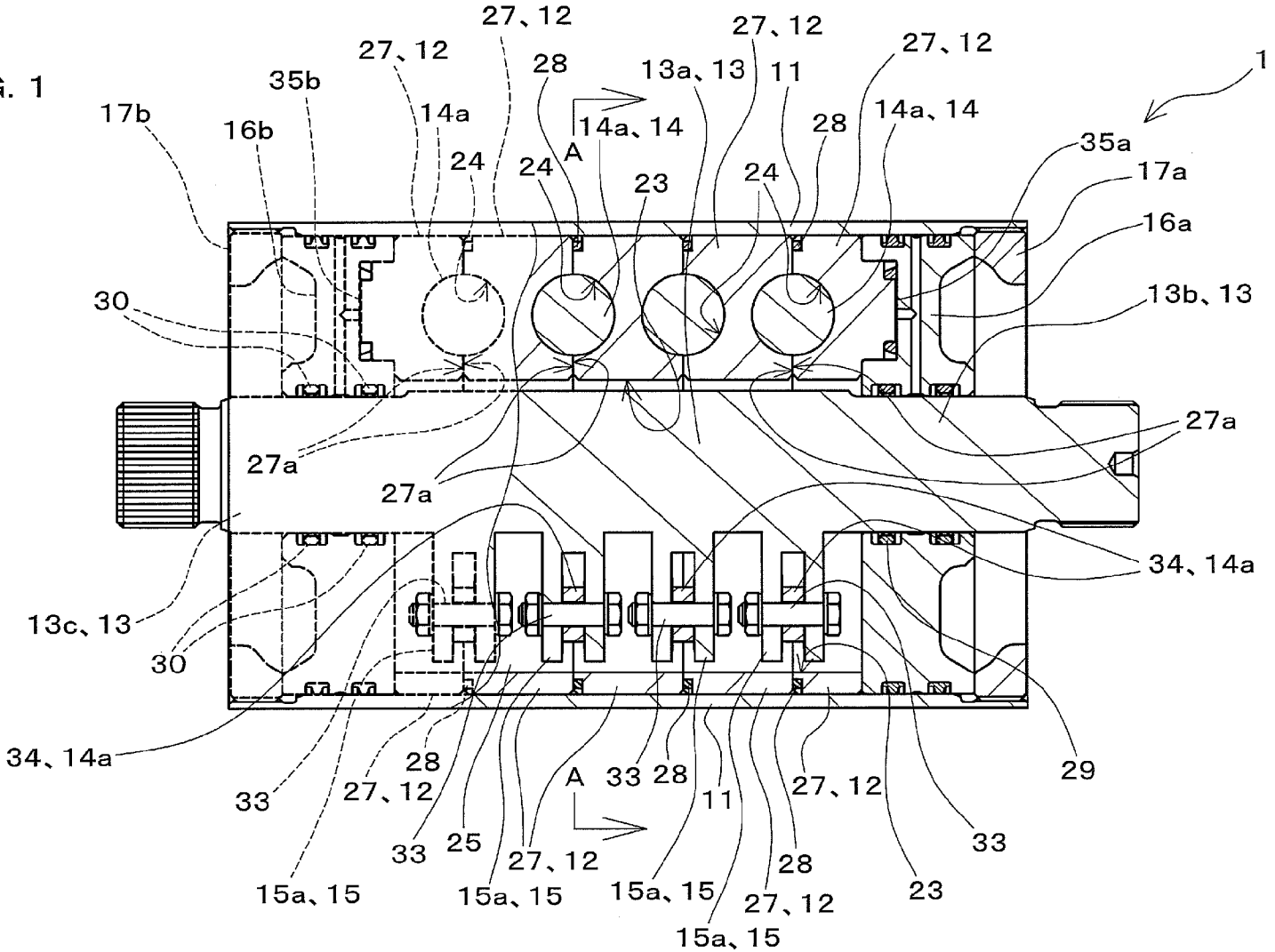
FIG. 1 is a diagram showing a rotary actuator according to one embodiment of the present invention viewed from a direction perpendicular to an axial direction, including a partial cross-sectional view thereof.
Figure 2:
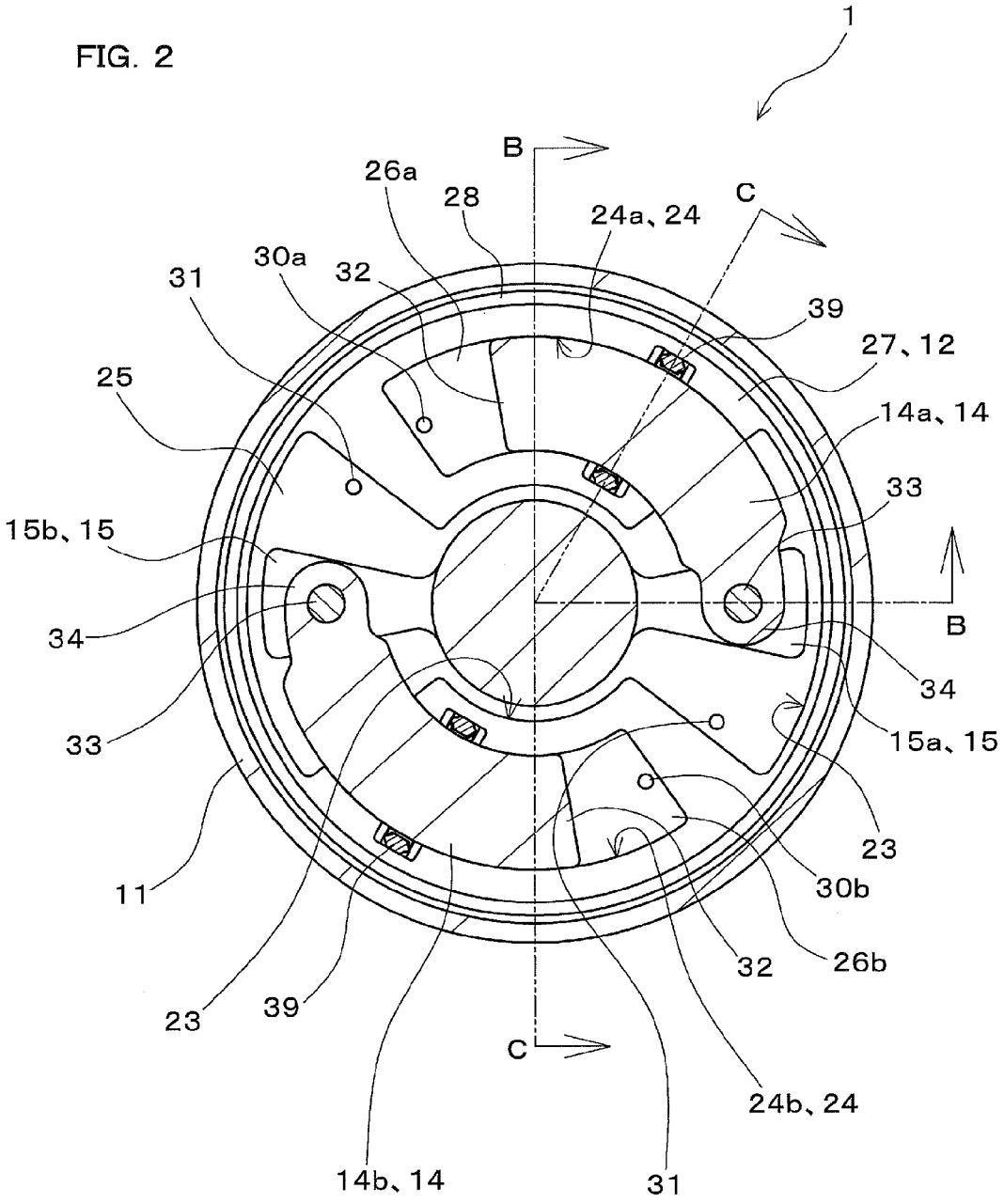
FIG. 2 is a cross-sectional view of the rotary actuator shown in FIG. 1, viewed along arrows A-A.
Figure 3:
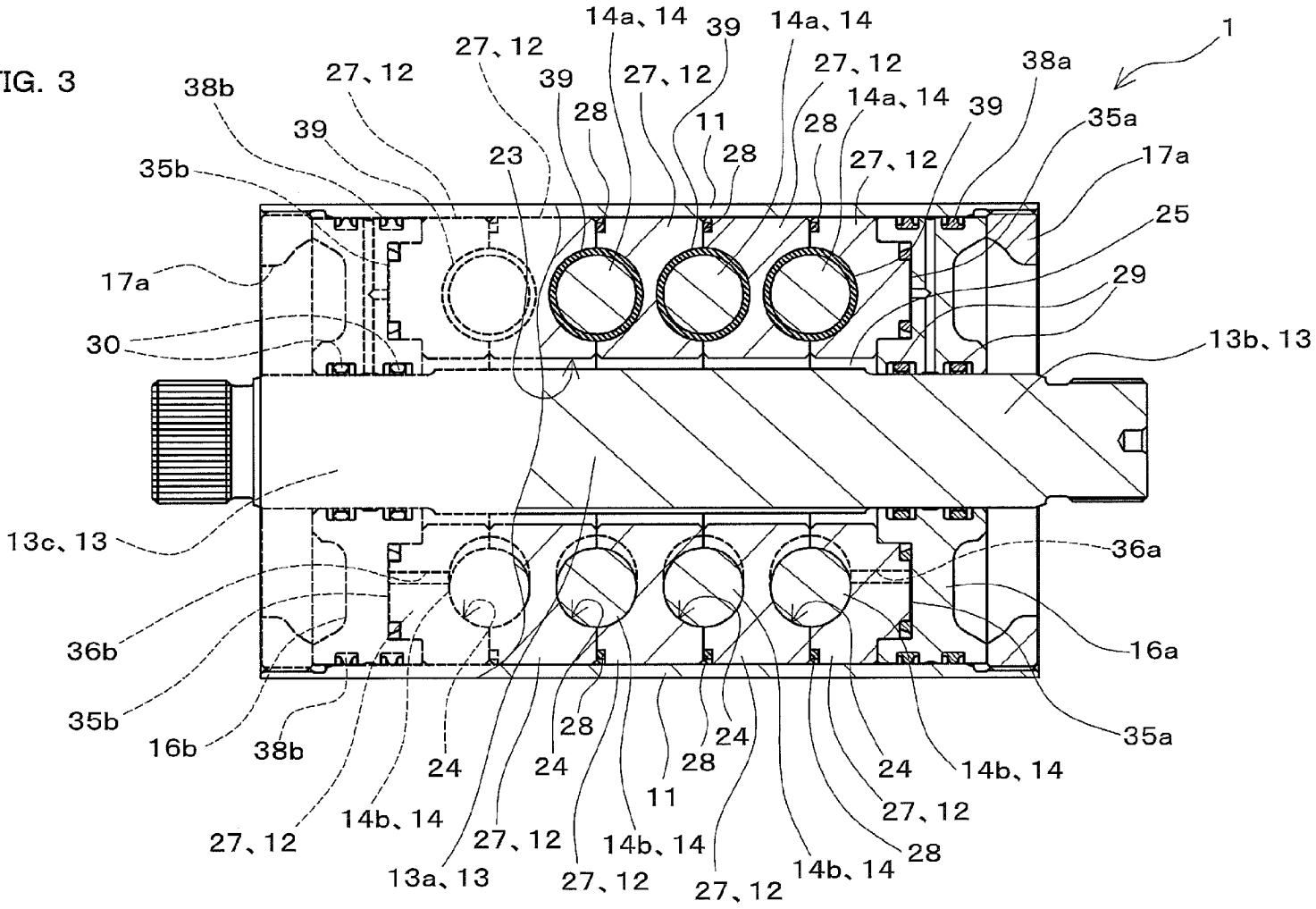
FIG. 3 is a cross-sectional view of the rotary actuator shown in FIG. 2, viewed along arrows C-C.

FIG. 1 is a diagram showing a rotary actuator 1 according to one embodiment of the present invention viewed from a direction perpendicular to an axial direction, including a partial cross-sectional view thereof. FIG. 2 is a cross-sectional view of the rotary actuator 1, viewed along arrows A-A in FIG. 1. Note that FIG. 1 includes the cross-section viewed along arrows B-B indicated by dashed lines in FIG. 2. FIG. 3 is a diagram showing the rotary actuator 1 including a cross-sectional view thereof, viewed along arrows C-C indicated by two-dot chain lines in FIG. 2.

The rotary actuator 1 shown in FIGS. 1 to 3 is provided as an actuator that outputs a driving torque as a result of an output shaft 13 pivoting in a rotational direction around its shaft center due to an action of a pressure medium. The pressure medium can be various kinds of pressure fluid such as compressed air or pressure oil. The pressure medium may be powder in the form of powder particles made of a metal material, a resin material, a ceramic material, a composite material of these materials, or the like. Note that the present embodiment will be described, taking, as an example, a mode of using pressure oil as the pressure medium.

As shown in FIGS. 1 to 3, the rotary actuator 1 is provided with a case 11, a cylinder 12, an output shaft 13, a plurality of piston units 14, a plurality of arm units 15, a plurality of pressure chamber defining members (16*a*, 16*b*), a plurality of ring nuts (17*a*, 17*b*), and so on. Note that the case 11, the cylinder 12, the output shaft 13, the piston units 14, the arm units 15, the pressure chamber defining members (16*a*, 16*b*), and the ring nuts (17*a*, 17*b*) are made mainly of, for example, a metal material such as stainless steel, titanium alloy, aluminum alloy, or copper alloy.

The case 11 is provided as, for example, a cylindrical member, which is internally hollow and open at both ends thereof. The pressure chamber defining members (16*a*, 16*b*) and the ring nuts (17*a*, 17*b*), which will be described later, are inserted in and fixed to both open ends of the case 11. The both ends of the case 11 are closed by the pressure chamber defining members (16*a*, 16*b*). Note that each pressure chamber defining member (16*a*, 16*b*), which will be described later, is provided as a member that has a ring-shaped portion with a predetermined thickness, and a through hole is formed in its center through which the ends of the output shaft 13, which will be described later, pass and protrude.

Figure 4:
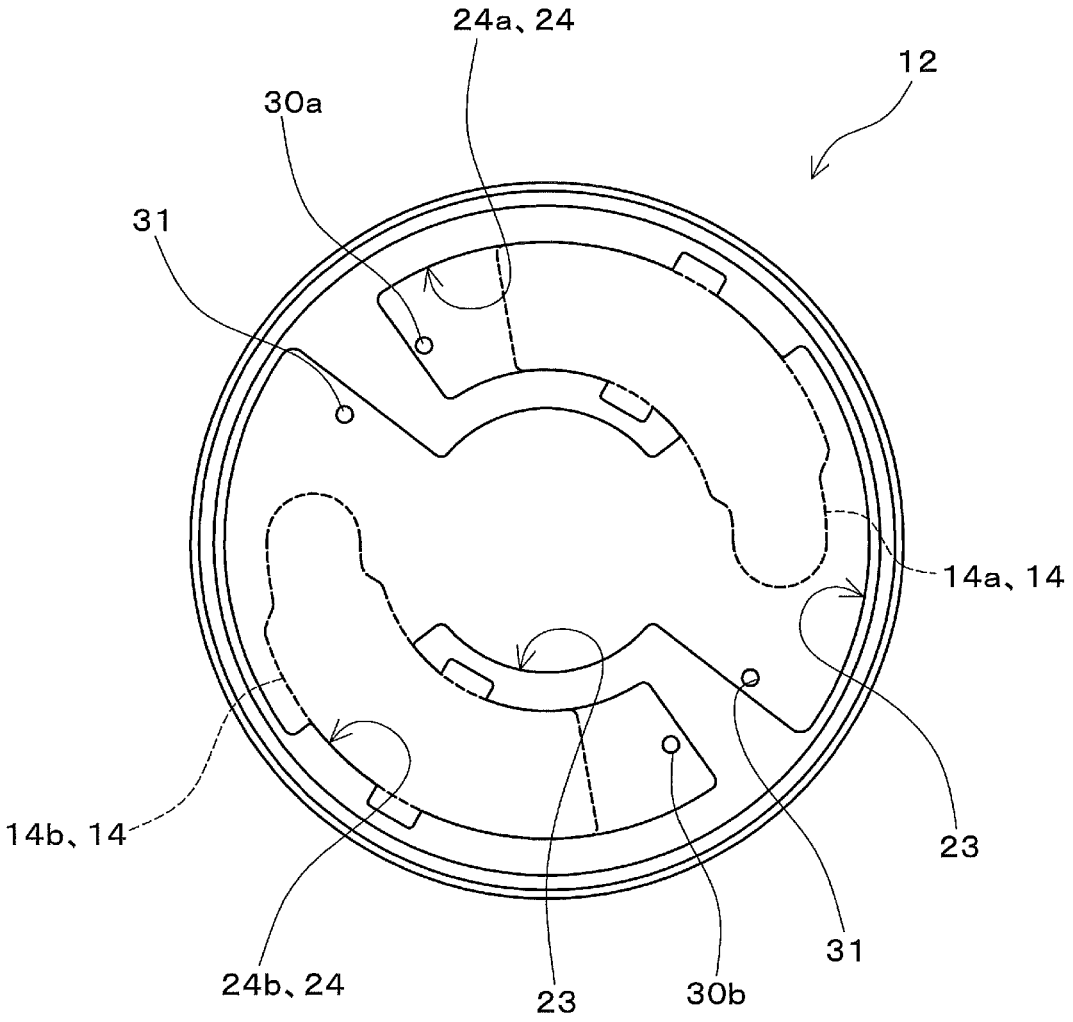
FIG. 4 is a cross-sectional view of a cylinder in the rotary actuator shown in FIG. 2.

FIG. 4 is a cross-sectional view of the cylinder 12 showing the cross-section corresponding to FIG. 2. Note that in FIG. 4, the piston unit 14 is also shown by two-dot chain lines. As shown in FIGS. 1 to 4, the cylinder 12 has a cylindrical structure that is installed inside the case 11 and internally provided with a hollow space 23. The hollow space 23 is provided as a hollow space extending along the axial direction of the cylinder 12, and the output shaft 13, which will be described later, is installed therein. Note that the axial direction of the cylinder 12, the axial direction of the actuator 1 that is a longitudinal direction of the actuator 1, the cylinder axial direction of the case 11, and the axial direction of the output shaft 13 are configured as directions parallel to one another, and may be configured as the same direction.

Within the cylinder 12, a plurality of piston chambers 24 are provided, each being a long hole extending in an arc along the circumferential direction of the cylinder 12. The plurality of piston chambers 24 are provided, each extending in the circumferential direction of the cylinder 12 along the same plane perpendicular to the axial direction of the cylinder 12. Note that in the present embodiment, two piston chambers 24 (24*a*, 24*b*) are provided along the same plane perpendicular to the axial direction of the cylinder 12 so as to extend in the circumferential direction of the cylinder 12.

Furthermore, in the cylinder 12, pairs of piston chambers 24 (24*a*, 24*b*) provided along the circumferential direction of the cylinder 12 are arranged in line along the axial direction of the cylinder 12. In other words, the pairs of piston chambers 24 (24*a*, 24*b*) are provided along the respective planes that are perpendicular to the axial direction of the cylinder 12 so as to extend along the circumferential direction of the cylinder 12.

Each piston chamber 24 is provided as a hole that is in communication with the hollow space 23 inside the cylinder 12. The piston chambers 24 are defined so that movement of the pressure oil between the piston chambers 24 and the hollow space 23 is prevented by arc pistons (14*a*, 14*b*) in the piston units 14, which will be described later. Note that the piston chamber 24*a* is defined so that movement of the pressure oil between the piston chamber 24*a* and the hollow space 23 is prevented by the arc piston 14*a*. Meanwhile, the piston chamber 24*b* is defined so that movement of the pressure oil between the piston chamber 24*b* and the hollow space 23 is prevented by the arc piston 14*b*. Note that the piston chamber 24*a* defines a second pressure chamber 26*a*, which will be described later, between the piston chamber 24*a* and the arc piston 14*a*. The piston chamber 24*b* defines a second pressure chamber 26*b*, which will be described later, between the piston chamber 24*b* and the arc piston 14*b*.

Further, the cylinder 12 is provided with a plurality of cylinder blocks 27 formed in a divided state. Each cylinder block 27 is provided as a cylindrical member whose length in the axial direction is short. The cylinder blocks 27 are put together along the axial direction of the cylinder 12 inside the case 11, and thus the cylinder 12 is integrally assembled.

Further, each cylinder block 27 is provided with an area formed as a through hole that constitutes part of the hollow space 23, and grooves having a semicircular cross-section and extending in an arc along the circumferential direction of the cylinder 12. Each cylinder block 27 installed at a position other than both ends in the axial direction of the cylinder 12 is provided with those grooves on both end faces in the axial direction. Meanwhile, each of the cylinder blocks 27 installed at both ends in the axial direction of the cylinder 12 is provided with the groove on one end face in the axial direction. These grooves are put together so as to face each other to form a circular cross-section between the cylinder blocks 27 that are adjacent to each other in the axial direction of the cylinder 12, thereby defining the piston chambers 24.

Further, in the cylinder blocks 27 that are adjacent to each other in the axial direction of the cylinder 12, a fitting face 27*a* on which the above-mentioned grooves each having a semicircular cross-section are formed and put together is formed as a plain face so that the cylinder blocks 27 are brought in close contact with each other (see FIG. 1). Thus, leakage of the pressure oil between the adjacent cylinder blocks 27 is sufficiently prevented. Note that a ring-shaped seal member 28 is inserted into one of two adjacent cylinder blocks 27 at an outer circumferential edge portion of the fitting face 27*a*. The seal member 28 is a seal member for static use with low pressure.

Furthermore, in the present embodiment, among the plurality of cylinder blocks 27, the cylinder blocks 27 installed at positions other than both ends in the axial direction of the cylinder 12 and the cylinder blocks 27 installed at both ends have different end face configurations. In the cylinder blocks 27 installed at positions other than both ends in the axial direction of the cylinder 12, both end faces in the axial direction of the cylinder 12 are provided as the fitting faces 27*a* that are brought in close contact with the cylinder block 27 to be fitted together, and with which the piston chamber 24 is formed. On the other hand, in the cylinder blocks 27 installed at both ends in the axial direction of the cylinder 12, one end face is provided as the fitting face 27*a* that is brought in close contact with the cylinder block 27 to be fitted together, and with which the piston chamber 24 is formed. The other end face of these cylinder blocks 27 is provided as an end face that defines the third pressure chambers (35*a*, 35*b*), which will be described later.

Note that when forming the above-mentioned grooves each having a semicircular cross-section that make holes with a circular cross-section to form the piston chambers 24 as a result of the cylinder blocks 27 being put together, firstly, machining of the material of the cylinder blocks 27 is performed to make the grooves that extend in an arc in the circumferential direction of the cylinder 12, for example. After the machining, polishing is performed on the machined wall surfaces that constitute the semicircular cross-sections, thereby forming the grooves that extend in an arc in the circumferential direction of the cylinder 12 having a smooth arc cross-section.

The output shaft 13 is supported rotatably with respect to the case 11 via the pressure chamber defining members (16*a*, 16*b*), which will be described later, and installed in the hollow space 23, with the axial direction being parallel to the axial direction of the cylinder 12. The output shaft 13 is provided with a shaft portion 13*a* and end portions (13*b*, 13*c*).

The shaft portion 13*a* is provided as a columnar portion whose axial direction coincides with the axial direction of the cylinder 12. The end portions 13*b* and 13*c* are integrated with the respective ends of the shaft portion 13*a*. The end portion 13*b* is supported so as to be able to slide and rotate with respect to the pressure chamber defining member 16*a*. The end portion 13*b* is supported so as to be able to slide and rotate with respect to the pressure chamber defining member 16*b*.

Ring-shaped seal members 29 are installed between the outer circumference of the end portion 13*b* and the inner circumference of the through hole of the pressure chamber defining member 16*a*. In the present embodiment, the seal members 29 are inserted in seal grooves formed on the inner circumference of the pressure chamber defining member 16*a*, and the end portion 13*b* is inserted inward of the seal members 29. Note that in the present embodiment, a plurality of the seal members 29 are installed. Meanwhile, ring-shaped seal members 30 are also installed between the outer circumference of the end portion 13*c* and the inner circumference of the through hole of the pressure chamber defining member 16*b*. In the present embodiment, the seal members 30 are inserted in seal grooves formed on the inner circumference of the pressure chamber defining member 16*b*, and the end portion 13*c* is inserted inward of the seal members 30. Note that in the present embodiment, a plurality of the seal members 30 are installed.

The output shaft 13 and the pressure chamber defining members (16*a*, 16*b*) are sealed against each other by these seal members (29, 30). Each of the seal members (29, 30) is formed in a ring shape, and the outer circumference of the output shaft 13 slides in the circumferential direction along the inner circumference of the seal members (29, 30). Therefore, the seal members (29, 30) are configured as seals in a linear sliding mode in which a contact portion that comes in contact with the outer circumferential surface of the end portions (13*b*, 13*c*) of the output shaft 13, which is the surface relative to which the seal members slide, is relatively displaced and uniformly slides along the circumferential direction of the output shaft 13. Note that those seal members (29, 30) do not necessarily have to be provided. Even in this case, the outer circumference of the output shaft 13 and the inner circumference of the pressure chamber defining members (16*a*, 16*b*) are sufficiently sealed against each other.

Furthermore, the seal grooves in which the seal members (29, 30) are inserted do not necessarily have to be provided on the pressure chamber defining members (16*a*, 16*b*). The seal grooves into which the seal members (29, 30) are inserted may be provided only on the end portions (13*b*, 13*c*), or may be provided on both the pressure chamber defining members (16*a*, 16*b*) and the end portions (13*b*, 13*c*).

Each arm unit 15 has a plurality of arms (15*a*, 15*b*). In the present embodiment, the arm unit 15 has a pair of (two) arms (15*a*, 15*b*). Each arm (15*a*, 15*b*) is integrated with the output shaft 13 and provided so as to extend in the radial direction of the cylinder 12. Furthermore, in the present embodiment, a plurality of the arm units 15 are provided and arranged in line along the axial direction of the output shaft 13. Therefore, the plurality of arms (15*a*, 15*b*) are provided so as to extend in the radial direction of the cylinder 12 from a plurality of positions on the output shaft 13. In the present embodiment, the arms (15*a*, 15*b*) are provided so as to extend in the radial direction of the cylinder 12 from a plurality of positions in the axial direction of the output shaft 13, as well as from a plurality of positions in the circumferential direction of the output shaft 13. The arms (15*a*, 15*b*) are installed together with the output shaft 13 in the hollow space 23. Note that the arms (15*a*, 15*b*) may be provided as separate members from the output shaft 13 and fixed to the output shaft 13.

Furthermore, in the present embodiment, each arm (15*a*, 15*b*) has two plate-like portions whose outer form substantially is a trapezoid having corners each formed in an arc shape. One end side of each arm (15*a*, 15*b*) is integrated with the output shaft 13 so as to be held thereby in a cantilevered manner. The two plate-like portions of the arm (15*a*, 15*b*) are provided along a direction perpendicular to the axial direction of the output shaft 13 so as to extend parallel to each other.

The arms 15*a* and 15*b* in each arm units 15 are provided so as to extend in the radial direction of the cylinder 12 from the same position in the axial direction of the output shaft 13. Furthermore, the arms 15*a* and 15*b* in each arm unit 15 are provided so that the angle formed by the arms 15*a* and 15*b* in the circumferential direction of the cylinder 12 is 180 degrees, that is, so as to extend from the output shaft 13 along the diameter direction of the cylinder 12 in the radial direction of the cylinder 12. Thus, in the present embodiment, a configuration is implemented in which the plurality of arms (15*a*, 15*b*) are provided so as to extend in the radial direction of the cylinder 12 along the same plane perpendicular to the axial direction of the output shaft 13.

Figure 5:
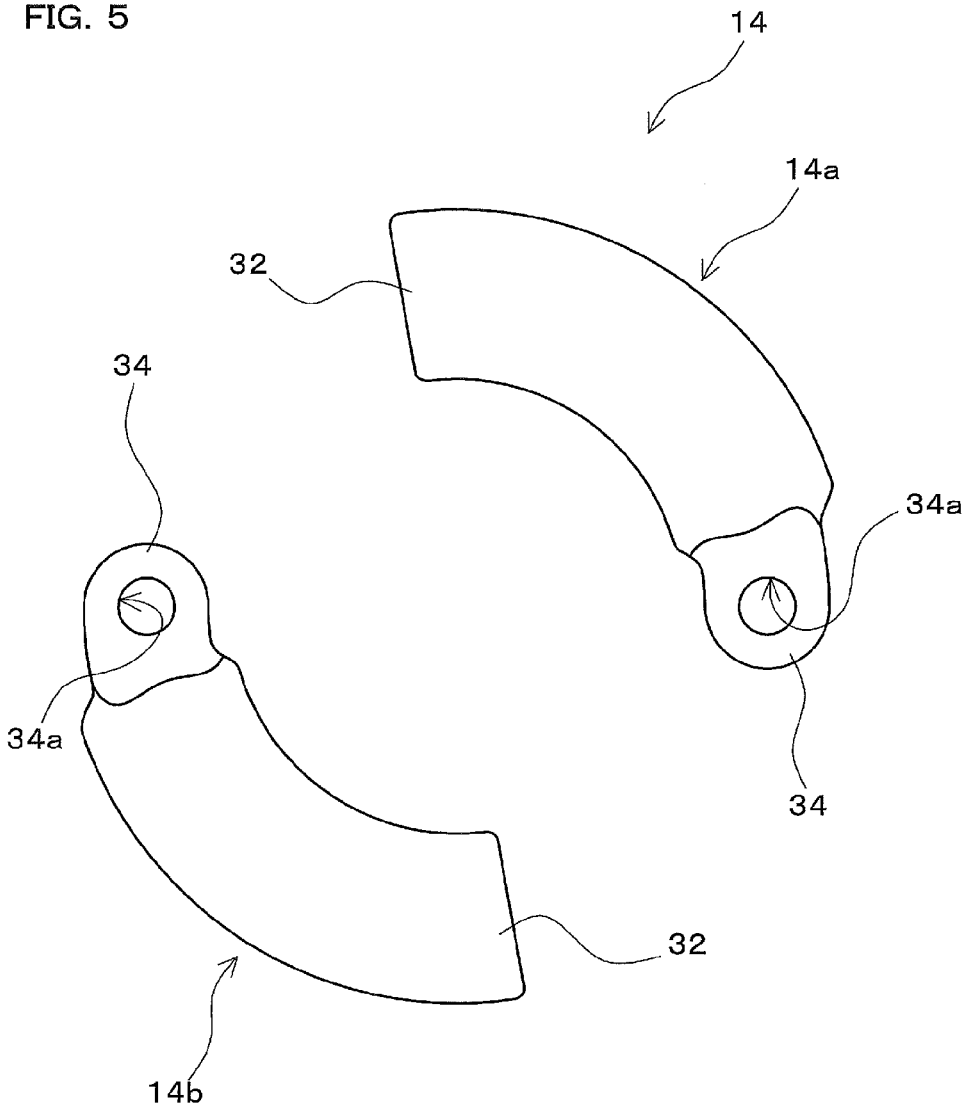
FIG. 5 is a diagram showing a piston unit in the rotary actuator shown in FIG. 2.

FIG. 5 is a diagram showing the piston unit 14. The rotary actuator 1 is provided with the plurality of piston units 14 shown in FIGS. 1 to 5, and each piston unit 14 is configured as a pair of arc pistons (14*a*, 14*b*). The piston units 14 are arranged in line along the axial direction of the output shaft 13. Each arc piston (14*a*, 14*b*) constitutes a piston in the present embodiment. Further, each arc piston (14*a*, 14*b*) is formed in an arc shape, and is provided with a portion that has a circular cross-section and extends in an arc. Note that with the above configuration, in the present embodiment, a configuration is implemented in which the plurality of arc pistons (14*a*, 14*b*) are provided and arranged in line along the axial direction of the output shaft 13.

The arc pistons (14*a*, 14*b*) are installed in the piston chambers 24 inside the cylinder 12 and supported so as to be able to slide and be displaced with respect to the cylinder 12 along the circumferential direction of the cylinder 12. The pairs of arc pistons (14*a*, 14*b*) are installed in the piston chambers 24 (24*a*, 24*b*) defined between adjacent cylinder blocks 27. Note that the arc pistons 14*a* are installed in the piston chambers 24*a*, and the arc pistons 14*b* are installed in the piston chambers 24*b*.

Furthermore, the arc pistons (14*a*, 14*b*) are installed slidably with respect to the wall surface of the piston chambers (24*a*, 24*b*) along the direction in which the piston chambers (24*a*, 24*b*) extend in an arc. In other words, the arc pistons 14*a* are slidably installed in the piston chambers 24*a*, and the arc pistons 14*b* are slidably installed in the piston chambers 24*b*. Note that in the cylinder 12, the piston chambers 24 (24*a*, 24*b*) are provided as space for housing the arc pistons (14*a*, 14*b*) that are supported so as to be able to slide and be displaced with respect to the cylinder 12.

As described above, each piston unit 14 is constituted by the plurality of arc pistons (14*a*, 14*b*) installed along the same plane perpendicular to the axial direction of the output shaft 13 so as to extend in the circumferential direction of the cylinder 12. Note that the plurality of arc pistons (14*a*, 14*b*) in each piston unit 14 and the plurality of arms (15*a*, 15*b*) in each arm unit 15 are installed so as to extend along the same plane perpendicular to the axial direction of the output shaft 13.

The wall surface of each piston chamber (24*a*, 24*b*) is provided with a seal groove, and a ring-shaped seal member 39 is inserted in this seal groove. For example, one seal member 39 is installed for each arc piston (14*a*, 14*b*) in each piston chamber (24*a*, 24*b*). The arc pistons (14*a*, 14*b*) are slidably inserted in the respective seal members 39. Thus, the liquid tightness or air tightness between the wall surface of the piston chambers (24*a*, 24*b*) and the outer circumference of the arc pistons (14*a*, 14*b*) is further improved. Each of these seal members 39 is configured as a seal in a linear sliding mode in which an inner circumferential contact portion, which comes in contact with the outer circumference of the arc piston (14*a*, 14*b*) that is the surface relative to which the seal slides, is relatively displaced and uniformly slides with respect to this surface along the circumferential direction of the cylinder 12. Note that these seal members 39 do not necessarily have to be provided. Even in this case, the wall surface of the piston chambers (24*a*, 24*b*) and the outer circumference of the arc pistons (14*a*, 14*b*) are sufficiently sealed against each other. Alternatively, a configuration may be implemented in which the seal members 39 are inserted in not the piston chambers (24*a*, 24*b*) but the arc pistons (14*a*, 14*b*).

Note that when manufacturing the arc pistons (14*a*, 14*b*), first, for example, two portions of a circular ring member in the circumferential direction are cut off by machining. The two portions that are thus cut off are set to be, for example, two portions that are opposite to each other via the center of the circular ring member in the radial direction, that is, two portions of the circular ring member that are diametrically opposed. Thus, the material of the pair of arc pistons (14*a*, 14*b*) is cut out of the circular ring member. Next, polishing is performed on the outer circumference of the material of the pair of arc pistons (14*a*, 14*b*), thereby forming the outer circumferential side surface of the arc pistons (14*a*, 14*b*) that form a circular cross-section and slide with respect to the piston chambers 24 (24*a*, 24*b*).

Each of the arc pistons (14*a*, 14*b*) in each piston unit 14 is provided with a piston head portion 32 and a connecting portion 34. The piston head portion 32 is provided at one end of each arc piston (14*a*, 14*b*) in the circumferential direction, which is the direction in which the arc piston (14*a*, 14*b*) extends in an arc (i.e., the longitudinal direction of the arc piston (14*a*, 14*b*)).

The connecting portion 34 is provided at the other opposite end of the arc piston (14*a*, 14*b*) in the circumferential direction, which is the direction in which the arc piston (14*a*, 14*b*) extends in an arc (i.e., the longitudinal direction of the arc piston (14*a*, 14*b*)). The connecting portion 34 is rotatably connected to the arm (15*a*, 15*b*). In other words, the arc pistons (14*a*, 14*b*) in each piston unit 14 are rotatably connected at their connecting portions 34 to the respective arms (15*a*, 15*b*) in the corresponding arm unit 15, via rotary shafts 33. Note that the connecting portion 34 of the arc piston 14*a* is rotatably connected to the arm 15*a* via the rotary shaft 33. The connecting portion 34 of the arc piston 14*b* is rotatably connected to the arm 15*b* via the rotary shaft 33.

In the present embodiment, the connecting portion 34 of each arc piston (14*a*, 14*b*) is provided as a plate-like portion thinly extending from the portion having a circular cross-section and extending in an arc. This connecting portion 34 has a through hole 34*a* through which the rotary shaft 33 passes in a relatively rotatable state around its shaft center. The connecting portion 34 of each arc piston (14*a*, 14*b*) is installed so as to project from an opening of the piston chamber (24*a*, 24*b*) to the hollow space 23.

Furthermore, the connecting portion 34 of each arc piston (14*a*, 14*b*) is installed between the two plate-like portions of the arm (15*a*, 15*b*) with a small gap between the connecting portion 34 and each plate-like portion. Each plate-like portion of each arm (15*a*, 15*b*) has a through hole. The connecting portion 34 of each arc piston (14*a*, 14*b*) is installed with respect to the arm (15*a*, 15*b*) in a positional relationship in which both through holes in the pair of plate-like portions are in communication with the through hole 34*a* of the connecting portion 34. Note that the connecting portion 34 of each arc piston 14*a* is installed between the two plate-like portions of the arm 15*a*, and the connecting portion 34 of each arc piston 14*b* is installed between the two plate-like portions of the arm 15*b*.

In the present embodiment, each rotary shaft 33 is configured as a bolt member having a pin-like shaft portion of a columnar shape provided with an external thread portion at its tip. Each rotary shaft 33 is installed so as to pass through the two plate-like portions of the arm (15*a*, 15*b*) and the connecting portion 34 of the arc piston (14*a*, 14*b*) installed between the two plate-like portions. At this time, the rotary shaft 33 engages at its bolt head with one of the two plate-like portions of the arm (15*a*, 15*b*) from the outside, and the external thread portion on the tip side projects from the other plate-like portion. Furthermore, each rotary shaft 33 is mounted so that a nut member provided with an inner circumferential internal thread portion is screwed with the external thread portion at the tip of the rotary shaft 33. Note that a detent is provided to the nut member and the tip of each rotary shaft 33 to prevent the nut member from falling away from the rotary shaft 33.

Thus, the connecting portion 34 of each arc piston (14*a*, 14*b*) is installed rotatably with respect to the arm (15*a*, 15*b*) via the rotary shaft 33 between the two plate-like portions of the arm (15*a*, 15*b*). Furthermore, the pairs of arc pistons (14*a*, 14*b*) in the piston units 14 are provided so as to be able to bias the respective pairs of arms (15*a*, 15*b*) in the arm units 15 in the same rotational direction along the circumferential direction of the cylinder 12.

Here, the configuration of the first pressure chamber 25 and the second pressure chambers (26*a*, 26*b*) for operating the arc pistons (14*a*, 14*b*) by means of supply and discharge of the pressure oil will be described. The first pressure chamber 25 and the second pressure chambers (26*a*, 26*b*) are provided inside the cylinder 12.

The first pressure chamber 25 is provided as an area into which the pressure oil serving as the pressure medium is introduced. The first pressure chamber 25 is formed by the hollow space 23, and houses the output shaft 13 and the plurality of arm units 15. To the first pressure chamber 25, a plurality of supply/discharge holes 31 through which the pressure oil is supplied and discharged are open. The supply/discharge holes 31 are provided as, for example, holes that are in communication with the first pressure chamber 25 in the pressure chamber defining member 16*b*. When the pressure oil is supplied to the first pressure chamber 25, the pressure oil is supplied from the plurality of supply/discharge holes 31 with substantially the same timing. When the pressure oil is discharged from the first pressure chamber 25, the pressure oil is discharged from the plurality of supply/discharge holes 31 with substantially the same timing.

The second pressure chambers (26*a*, 26*b*) are configured as areas defined respectively in the piston chambers (24*a*, 24*b*) in which the arc pistons (14*a*, 14*b*) are slidably supported. Each of the second pressure chambers (26*a*, 26*b*) is defined as an area into which the pressure oil serving as the pressure medium is introduced between the arc piston (14*a*, 14*b*) in the piston chamber (24*a*, 24*b*) and the cylinder 12. Further, in the second pressure chambers (26*a*, 26*b*), the piston head portions 32 of the arc pistons (14*a*, 14*b*) are installed so as to be opposite to each other. Note that the second pressure chamber 26*a* is defined by the wall surface of the piston chamber 24*a* and the piston head portion 32 of the arc piston 14*a*. The second pressure chamber 26*b* is defined by the wall surface of the piston chamber 24*b* and the piston head portion 32 of the arc piston 14*b*.

To each second pressure chamber 26*a*, a supply/discharge hole 30*a* through which the pressure oil is supplied and discharged is open. To each second pressure chamber 26*b* as well, a supply/discharge hole 30*b* through which the pressure oil is supplied and discharged is open. The supply/discharge holes 30*a* are provided so as to pass through the cylinder blocks 27 in the axial direction of the cylinder 12. The supply/discharge holes 30*a* in the respective cylinder blocks 27 are arranged in tandem throughout the cylinder blocks 27 so as to be in communication with one another. The supply/discharge holes 30*b* are also provided so as to pass through the cylinder blocks 27 in the axial direction of the cylinder 12. The supply/discharge holes 30*b* in the cylinder blocks 27 are arranged in tandem throughout the cylinder blocks 27 so as to be in communication with one another. Note that the supply/discharge holes 30*a* may be branched from a common oil supply/discharge path to the respective second pressure chambers 26*a* so as to be in communication with the second pressure chambers 26*a*. The supply/discharge holes 30*b* may also be branched from a common oil supply/discharge path to the respective second pressure chambers 26*b* so as to be in communication with the second pressure chambers 26*b*.

The pressure oil is supplied to and discharged from the second pressure chamber 26*a* and the second pressure chamber 26*b* with substantially the same timing. When the pressure oil is supplied to the second pressure chamber 26*a* and the second pressure chamber 26*b*, the pressure oil is supplied from the supply/discharge hole 30*a* and the supply/discharge hole 30*b* with substantially the same timing. When the pressure oil is discharged from the second pressure chamber 26*a* and the second pressure chamber 26*b*, the pressure oil is discharged from the supply/discharge hole 30*a* and the supply/discharge hole 30*b* with substantially the same timing.

In the rotary actuator 1, the pressure oil is supplied to one of the first pressure chamber 25 and the second pressure chambers (26*a*, 26*b*), and is discharged from the other of the first pressure chamber 25 and the second pressure chambers (26*a*, 26*b*). Each pair of arc pistons (14*a*, 14*b*) is thereby displaced. Thus, the pair of arms (15*a*, 15*b*) biased by the pair of arc pistons (14*a*, 14*b*) is displaced in the circumferential direction of the cylinder 12. Then, the output shaft 13 pivots together with the arms (15, 15*b*) in the rotational direction around its shaft center.

Further, in the rotary actuator 1, the supply/discharge holes 30*a* in the plurality of cylinder blocks 27 are in communication with one another, and therefore, the pressure oil is supplied with substantially the same timing to, and discharged with substantially the same timing from, the plurality of second pressure chambers 26*a*. Meanwhile, the supply/discharge holes 30*b* in the plurality of cylinder blocks 27 are in communication with one another, and therefore, the pressure oil is supplied with substantially the same timing to, and discharged with substantially the same timing from, the plurality of second pressure chambers 26*b*. Further, as described above, the pressure oil is supplied with substantially the same timing to, and discharged with substantially the same timing from, the supply/discharge holes 30*a* and 30*b*.

For example, when the pressure oil is supplied from the supply/discharge holes (30*a*, 30*b*) and discharged from the supply/discharge holes 31, the arc piston 14*a* and the arc piston 14*b* are displaced clockwise along the circumferential direction of the cylinder 12 in FIG. 2. Thus, the arms (15*a*, 15*b*) and the output shaft 13 pivot clockwise along the circumferential direction of the cylinder 12 in FIG. 2. On the other hand, when the pressure oil is supplied from the supply/discharge holes 31 and discharged from the supply/discharge holes (30*a*, 30*b*), the arc piston 14*a* and the arc piston 14*b* are displaced anticlockwise along the circumferential direction of the cylinder 12 in FIG. 2. Thus, the arms (15*a*, 15*b*) and the output shaft 13 pivot anticlockwise along the circumferential direction of the cylinder 12 in FIG. 2.

Figure 6:
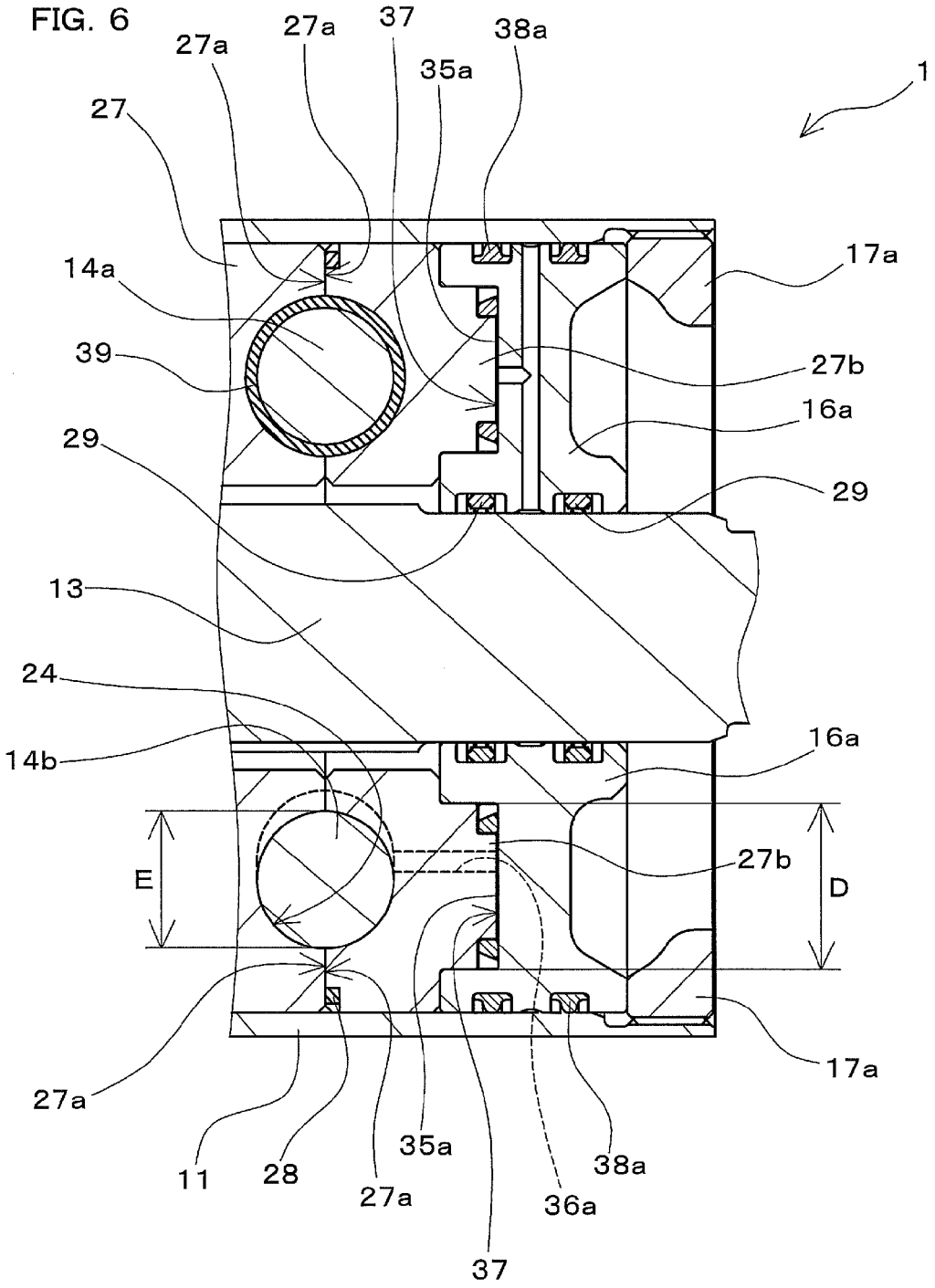
FIG. 6 is an enlarged cross-sectional view showing part of a cross-section of the rotary actuator shown in FIG. 3.

Next, the pressure chamber defining members (16*a*, 16*b*) and the ring nuts (17*a*, 17*b*) will be described. FIG. 6 is an enlarged cross-sectional view showing part of a cross-section of the rotary actuator 1 shown in FIG. 3, and is a cross-sectional view of the pressure chamber defining member 16*a* and the vicinity thereof. As shown in FIGS. 1, 3, and 6, the pressure chamber defining members (16*a*, 16*b*) are installed inside the case 11 on both sides of the cylinder 12 in the axial direction of the cylinder 12. The pressure chamber defining members (16*a*, 16*b*) are provided as members for defining the third pressure chambers (35*a*, 35*b*) between the pressure chamber defining members (16*a*, 16*b*) and the cylinder 12. Thus, the third pressure chambers (35*a*, 35*b*) are provided inside the case 11 on the both sides of the cylinder 12 in the axial direction thereof.

The pressure chamber defining members 16*a* and 16*b*, which are configured in the same manner, are provided as the members having a ring-shaped portion with a predetermined thickness, and have, in their center, a through hole through which the output shaft 13 passes. Further, each pressure chamber defining member (16*a*, 16*b*) extends along the circumferential direction of the cylinder 12 and has a dent portion 37 provided as a portion with a dent that defines the third pressure chamber (35*a*, 35*b*), on one end face side (see FIG. 6).

Also, the pressure chamber defining member 16*a* is installed on one end side in the axial direction of the cylinder 12, and defines the third pressure chambers 35*a* between the pressure chamber defining member 16*a* and the cylinder block 27 at one end in the axial direction of the cylinder 12. Note that in the present embodiment, two third pressure chambers 35*a* are provided on one end side in the axial direction of the cylinder 12. One of the two third pressure chambers 35*a* is provided at a position corresponding to the piston chambers 24*a* in a direction parallel to the axial direction of the cylinder 12. The other of the two third pressure chambers 35*a* is provided at a position corresponding to the piston chambers 24*b* in a direction parallel to the axial direction of the cylinder 12.

The pressure chamber defining member 16*b* is installed on the other end side in the axial direction of the cylinder 12, and defines the third pressure chambers 35*b* between the pressure chamber defining member 16*b* and the cylinder block 27 at the other end in the axial direction of the cylinder 12. Note that in the present embodiment, two third pressure chambers 35*b* are provided on the other end side in the axial direction of the cylinder 12. One of the two third pressure chambers 35*b* is provided at a position corresponding to the piston chamber 24*a* in a direction parallel to the axial direction of the cylinder 12. The other of the two third pressure chambers 35*b* is provided at a position corresponding to the piston chamber 24*b* in a direction parallel to the axial direction of the cylinder 12.

Each of the cylinder blocks 27 at both ends in the axial direction of the cylinder 12 has a projecting portion 27*b* provided as a portion with a projection that projects toward the pressure chamber defining member (16*a*, 16*b*) and extends along the circumferential direction of the cylinder 12 (see FIG. 6). The projecting portions 27*b* are fitted into the respective dent portions 37 of the pressure chamber defining members (16*a*, 16*b*) so as to be able to slide and relatively move in a direction parallel to the axial direction of the cylinder 12. The third pressure chambers (35*a*, 35*b*) are defined between the projecting portions 27*b* and the dent portions 37.

Communication paths 36*a* provided as through holes that extend parallel to the axial direction of the cylinder 12 are provided in the cylinder block 27 at one end in the axial direction of the cylinder 12. In the present embodiment, two communication paths 36*a* are provided. One of the two communication paths 36*a* is provided so as to pass through the cylinder blocks 27 from the piston chamber 24*a* on one end side in the axial direction of the cylinder 12 to one of the two third pressure chambers 35*a*. The other of the two communication paths 36*a* is provided so as to pass through the cylinder blocks 27 from the piston chamber 24*b* on one end side in the axial direction of the cylinder 12 to the other of the two third pressure chambers 35*a*.

With the above configuration, the third pressure chambers 35*a* are configured to be in communication with the respective second pressure chambers (26*a*, 26*b*) on one end side in the axial direction of the cylinder 12. In the cylinder 12, all second pressure chambers 26*a* in the piston chambers 24*a* are in communication with one another via the supply/discharge holes 30*a*, and all second pressure chambers 26*b* in the piston chambers 24*b* are also in communication with one another via the supply/discharge holes 30*b*. Therefore, in the present embodiment, one of the third pressure chambers 35*a* is in communication with all second pressure chambers 26*a*, and the other third pressure chamber 35*a* is in communication with all second pressure chambers 26*b*.

Also, communication paths 36*b* provided as through holes that extend parallel to the axial direction of the cylinder 12 are provided in the cylinder block 27 at the other end in the axial direction of the cylinder 12. Two communication paths 36*b* are provided. One of the two communication paths 36*b* is provided so as to pass through the cylinder blocks 27 from the piston chamber 24*a* on the other end side in the axial direction of the cylinder 12 to one of the two third pressure chambers 35*b*. The other of the two communication paths 36*b* is provided so as to pass through the cylinder blocks 27 from the piston chamber 24*b* on one end side in the axial direction of the cylinder 12 to the other of the two third pressure chambers 35*b*.

With the above configuration, the third pressure chambers 35*b* are configured to be in communication with the respective second pressure chambers (26*a*, 26*b*) on the other end side in the axial direction of the cylinder 12. In the cylinder 12, all second pressure chambers 26*a* in the piston chambers 24*a* are in communication with one another via the supply/discharge holes 30*a*, and all second pressure chambers 26*b* in the piston chambers 24*b* are also in communication with one another via the supply/discharge holes 30*b*. Therefore, in the present embodiment, one of the third pressure chambers 35*b* is in communication with all second pressure chambers 26*a*, and the other third pressure chamber 35*b* is in communication with all second pressure chambers 26*b*.

Further, in the rotary actuator 1, the area of the cross-section of each third pressure chamber (35*a*, 35*b*) that is perpendicular to the axial direction of the cylinder 12 is set to be larger than the area of the cross-section of each second pressure chamber (26*a*, 26*b*) that is perpendicular to the axial direction of the cylinder 12 and at the position of the fitting face 27*a* of adjacent cylinder blocks 27.

Note that, as shown in FIG. 6, the cross-section of each third pressure chamber 35*a* that is perpendicular to the axial direction of the cylinder 12 has a dimension in the radial direction of the cylinder 12 that is set to a dimension D (the dimension indicated by a double arrow D), and is configured as a cross-section that expands so as to extend along the circumferential direction of the cylinder 12 with the same width dimension D. Meanwhile, the cross-section of the each second pressure chamber (26*a*, 26*b*) at the position of the fitting face 27*a* has a dimension in the radial direction of the cylinder 12 that is set to a dimension E (the dimension indicated by a double arrow E), and is configured as a cross-section that expands so as to extend along the circumferential direction of the cylinder 12 with the same width dimension E. The dimension D is set to a dimension larger than the dimension E. Further, the cross-section of each third pressure chamber 35*a* that is perpendicular to the axial direction of the cylinder 12 has a length dimension in the circumferential direction of the cylinder 12 that is set to a larger length dimension than, or the same length dimension as, the cross-section of each second pressure chamber (26*a*, 26*b*) at the position of the fitting face 27*a*.

With the above configuration, the area of the cross-section of each third pressure chamber 35*a* that is perpendicular to the axial direction of the cylinder 12 is set to be larger than the area of the cross-section of each second pressure chamber (26*a*, 26*b*) at the position of the fitting face 27*a*. With the same configuration, the area of the cross-section of each third pressure chamber 35*b* that is perpendicular to the axial direction of the cylinder 12 is set to be larger than the area of the cross-section of each second pressure chamber (26*a*, 26*b*) at the position of the fitting face 27*a*. Note that the area of the cross-section of each third pressure chamber (35*a*, 35*b*) that is perpendicular to the axial direction of the cylinder 12 may be set to be the same as the area of the cross-section of each second pressure chamber (26*a*, 26*b*) at the position of the fitting face 27*a*.

Further, the pressure chamber defining members (16*a*, 16*b*) are fixed to the case 11 with the ring nuts (17*a*, 17*b*) so as to be in close contact with the inner circumference of the case 11. Note that a plurality of seal grooves are formed on the outer circumference of the pressure chamber defining member 16*a*. A ring-shaped seal member 38*a* is inserted in each seal groove on the outer circumference of the pressure chamber defining member 16*a*. Thus, the liquid tightness or air tightness between the outer circumference of the pressure chamber defining member 16*a* and the inner circumference of the case 11 is further improved. Also, a ring-shaped seal member 38*b* is inserted in each seal groove on the outer circumference of the pressure chamber defining member 16*b*. Thus, the liquid tightness or air tightness between the outer circumference of the pressure chamber defining member 16*b* and the inner circumference of the case 11 is further improved. Note that the seal members (38*a*, 38*b*) are seal members for static use with low pressure.

The ring nuts (17*a*, 17*b*) are provided as ring-shaped members provided with outer circumferential external thread portions that are screwed with inner circumferential internal thread portions provided in the case 11 on both ends. The ring nut 17*a* is screwed with and fixed to one end of the case 12 in a state where the pressure chamber defining member 16*a* defines the third pressure chambers 35*a* between the pressure chamber defining member 16*a* and the cylinder block 27 at one end of the cylinder 12. The pressure chamber defining member 16*a* is thereby fixed to the case 11 by the ring nut 17*a* in a state of being firmly pressed against the cylinder block 27 in a fastened manner. Further, the ring nut 17*b* is screwed with and fixed to the other end of the case 12 in a state where the pressure chamber defining member 16*b* defines the third pressure chambers 35*b* between the pressure chamber defining member 16*b* and the cylinder block 27 at the other end of the cylinder 12. The pressure chamber defining member 16*b* is thereby fixed to the case 11 by the ring nut 17*b* in a state of being firmly pressed against the cylinder block 27 in a fastened manner.

Note that the assembly operation of the above-described rotary actuator 1 can be implemented in various orders. Next, an exemplary assembly procedure of the rotary actuator 1 will be discussed. First, for example, an integrated molding of the output shaft 13 and the arm units 15 is attached to the pressure chamber defining member 16*b* in a state where the pressure chamber defining member 16*b* is held by a jig. Then, the cylinder blocks 27 are sequentially put together in tandem in the axial direction of the cylinder 12 in a state where the output shaft 13 and the arm units 15 are inserted inside the hollow space 23.

When the cylinder blocks 27 are sequentially put together, the arc pistons (14*a*, 14*b*) to which the seal members 39 are attached are installed in the respective piston chambers (24*a*, 24*b*) between the cylinder blocks 27. At this time, the arc pistons (14*a*, 14*b*) are rotatably connected to the respective arms (15*a*, 15*b*) via the rotary shafts 33. Then, at the stage where assembly by putting together the cylinder blocks 27 is completed, the pressure chamber defining member 16*a* is attached to the cylinder 12. Thereafter, the case 11 is mounted on the outer circumference of the cylinder 12 in a state where the cylinder 12 is inserted in the case 11. After mounting of the case 11 is completed, the pressure chamber defining member 16*b* is removed from the jig, the ring nut 17*a* is attached to one end of the case 11, and the ring nut 17*b* is attached to the other end of the case 11. The outline of the assembly operation of the rotary actuator 1 is thus completed.

Figure 7:
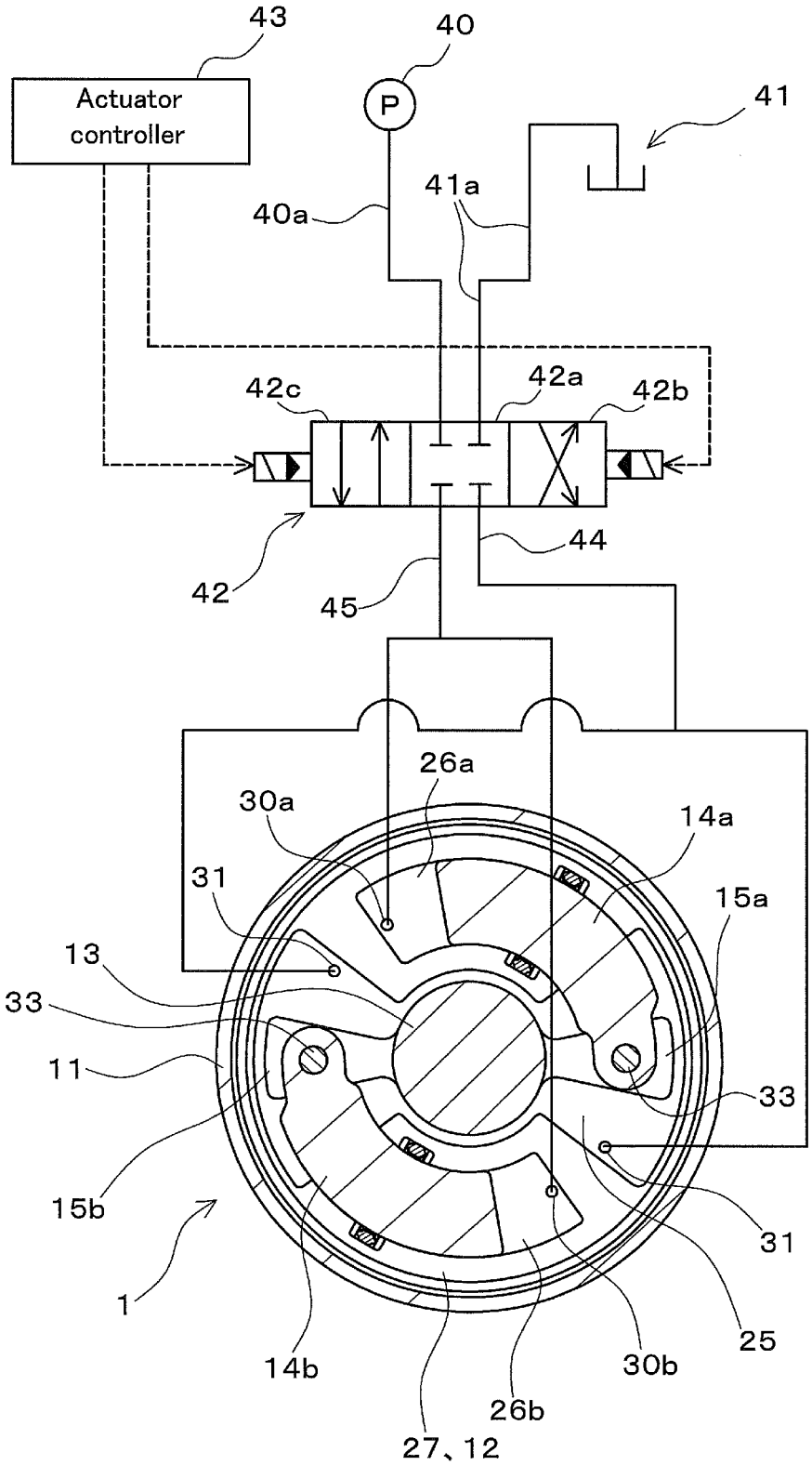
FIG. 7 is a circuit diagram schematically showing a hydraulic circuit for controlling operation of the rotary actuator shown in FIG. 2.

Operation of Rotary Actuator and Configuration of Hydraulic Circuit for Controlling Rotary Actuator Next, the configuration of a hydraulic circuit for controlling the operation of the above-described rotary actuator 1 and actuation of the rotary actuator 1 will be discussed. FIG. 7 is a circuit diagram schematically showing the hydraulic circuit for controlling the operation of the rotary actuator 1, together with the cross-sectional view of the rotary actuator 1 shown in FIG. 2. As shown in FIG. 7, the pressure oil serving as the pressure medium is supplied to the rotary actuator 1 from a hydraulic power source 40, which is a pressure medium supply source in the present embodiment. The hydraulic power source 40 includes a hydraulic pump. The pressure oil (oil) discharged from the rotary actuator 1 flows and returns to a reservoir circuit 41. The pressure oil, after returning to the reservoir circuit 41, is pressurized by the hydraulic power source 40, and is supplied again as pressure oil to the rotary actuator 1.

Between the hydraulic power source 40 and the rotary actuator 1 and between the reservoir circuit 41 and the rotary actuator 1, a control valve 42 is provided for switching a pressure oil supply path to the rotary actuator 1 and a pressure oil discharge path from the rotary actuator 1. In other words, the rotary actuator 1 is connected to the hydraulic power source 40 and the reservoir circuit 41 via the control valve 42.

The control valve 42 is provided as a valve mechanism for switching the state of connection of the supply path 40*a* in communication with the hydraulic power unit 40 and the discharge path 41*a* in communication with the reservoir circuit 41 to a pair of supply/discharge paths (44, 45) that are in communication with the rotary actuator 1. The supply/discharge path 44 is in communication with the supply/discharge holes 31 in the case 11, and the supply/discharge path 45 is in communication with the supply/discharge holes (30*a*, 30*b*) in the cylinder blocks 27.

Furthermore, the control valve 42 is provided as, for example, an electrohydraulic servo valve (EHSV). The control valve 42 operates to switch the state of connection of the supply path 40*a* and the discharge path 41*a* to the supply/discharge paths (44, 45) based on an instruction signal from an actuator controller 43 that controls the operation of the rotary actuator 1. More specifically, in the control valve 42, a nozzle-flapper hydraulic pressure amplification mechanism at the pilot stage is driven based on an electric instruction signal from the actuator controller 43, and the pressure of the pilot pressure oil introduced into both ends of the spool at the main stage is controlled. With the pilot pressure oil produced at the pilot stage, the position of the spool at the main stage is proportionally controlled, and the above-mentioned state of connection between the paths 40*a* and 41*a* and the paths 44 and 45 is switched.

With the above configuration, the control valve 42 is provided so as to be able to proportionally switch its position among a neutral valve position 42*a*, a first switching position 42*b*, and a second switching position 42*c*. In a state of being switched to the neutral valve position 42*a*, the control valve 42 disconnects the supply path 40*a* and the discharge path 41*a* from the supply/discharge paths (44, 45). Thus, supply and discharge of the pressure oil to/from the first pressure chamber 25 and the second pressure chambers (26*a*, 26*b*) are stopped. Then, the state where the arc pistons (14*a*, 14*b*) installed in the piston chambers (24*a*, 24*b*) are stopped is maintained.

Upon the control valve 42 being switched from the neutral valve position 42*a* to the first switching position 42*b*, the supply path 40*a* is connected to the supply/discharge path 44 and the pressure oil is supplied to the first pressure chamber 25. Meanwhile, the discharge path 41*a* is connected to the supply/discharge path 45 and the pressure oil is discharged from the second pressure chambers (26*a*, 26*b*). Thus, the arc pistons (14*a*, 14*b*) are displaced anticlockwise along the circumferential direction of the cylinder 12 in FIG. 7.

On the other hand, upon the control valve 42 being switched from the neutral valve position 42*a* to the second switching position 42*c*, the supply path 40*a* is connected to the supply/discharge path 45 and the pressure oil is supplied to the second pressure chambers (26*a*, 26*b*). Meanwhile, the discharge path 41*a* is connected to the supply/discharge path 44 and the pressure oil is discharged from the first pressure chamber 25. Thus, the arc pistons (14*a*, 14*b*) are displaced clockwise along the circumferential direction of the cylinder 12 in FIG. 7. As described above, when the control valve 42 is switched to the first switching position 42*b* and when it is switched to the second switching position 42*c*, the arc pistons (14*a*, 14*b*) installed in each piston chamber (24*a*, 24*b*) move in an opposite direction in the circumferential direction of the cylinder 12, and the arms 15 and the output shaft 13 are also driven to pivot in an opposite direction.

Further, when the control valve 42 is switched from the neutral valve position 42*a* to the second switching position 42*c* and the pressure oil is supplied to the second pressure chambers (26*a*, 26*b*), the pressure oil is also supplied to the third pressure chambers (35*a*, 35*b*) via the communication paths (36*a*, 36*b*). As a result of the pressure oil being supplied to the third pressure chambers (35*a*, 35*b*) as described above, the cylinder 12 is biased, due to an action of the supplied pressure oil, in a direction in which adjacent cylinder blocks 27 are pressed against each other.

Further, as described above, the arms 15 are driven by the arc pistons (14*a*, 14*b*), the output shaft 13 pivots, and a driving torque is thereby output from the output shaft 13. The driving torque may be output from one of the end portions 13*b* and 13*c* of the output shaft 13, or may be output from both end portions (13*b*, 13*c*) of the output shaft 13.

Note that the driving torque output from the output shaft 13 is output for an object to be driven that is connected to at least one of the end portions (13*b*, 13*c*). The object to be driven may be various kinds of equipment. For example, a moving surface such as a control surface provided pivotably on a wing of an aircraft may be driven by the rotary actuator 1. The rotary actuator 1 may also be applied to steering equipment for cars and the like.

Note that in the above embodiment, the control valve 42 and the actuator controller 43 are not described as components of the rotary actuator 1, but these may be included in the components of the rotary actuator 1. For example, the rotary actuator 1 may be defined as having a configuration including the control valve 42 as the component thereof. Alternatively, the rotary actuator 1 may be defined as having a configuration including the control valve 42 and the actuator controller 43 as the components thereof.

Effect of the Present Embodiment

As described above, with the rotary actuator 1, the pressure oil (pressure medium) is supplied to one of the first pressure chamber 25 and the second pressure chambers (26*a*, 26*b*) and is discharged from the other inside the cylinder 12 installed within the case 11, and the arc pistons (14*a*, 14*b*) thereby slide and are displaced in the circumferential direction of the cylinder 12. The arms (15*a*, 15*b*) to which the respective arc pistons (14*a*, 14*b*) are rotatably connected are driven by the arc pistons (14*a*, 14*b*), and the output shaft 13 thereby pivots together with the arms (15*a*, 15*b*) in the rotational direction. Thus, the driving torque of the rotary actuator 1 is output.

As described above, with the rotary actuator 1, the first pressure chamber 25 on the side of the connecting portions 34 of the arc pistons (14*a*, 14*b*) that slide with respect to the cylinder 12 and the second pressure chambers (26*a*, 26*b*) on the side of the piston head portions 32 are defined inside the cylinder 12. Thus, such a structure including pressure chambers defined by an output shaft, vanes, a cylinder, ribs, and end caps, as the structure of the conventional rotary actuators, is not necessary. In other words, the rotary actuator 1 does not need rotary sliding portions between the output shaft and the ribs provided on the cylinder, between the cylinder and the vanes provided on the rotary output shaft, and between the rotary output shaft with the vanes and the end caps. As a result, with the rotary actuator 1, internal leakage of the pressure oil (pressure medium) within the rotary actuator 1 can be reduced. In addition, the rotary actuator 1 does not need, or is able to significantly reduce the number of, the high-pressure rotary seals that are used in the rotary sliding portions and pressed with high pressure against the surface relative to which the seals slide.

Consequently, according to the present embodiment, it is possible to provide the rotary actuator 1 capable of reducing internal leakage of the pressure medium, and realizing a structure that does not need the high-pressure rotary seals, or is able to significantly reduce the number of the high-pressure rotary seals.

Furthermore, in the rotary actuator 1, the arc pistons (14*a*, 14*b*) that drive, via the arms (15*a*, 15*b*), the output shaft 13 to rotate are rotatably connected to the arms (15*a*, 15*b*). Therefore, even if an external load acts on the output shaft 13, the arms (15*a*, 15*b*) can be prevented from separating from the arc pistons (14*a*, 14*b*). Consequently, in the case where a servo control mechanism is built for control of the rotational position of the output shaft 13 driven by the arc pistons (14*a*, 14*b*) that are displaced due to supply and discharge of the pressure oil to/from the first pressure chamber 25 and second pressure chambers (26*a*, 26*b*), reduction in the responsiveness of this servo mechanism can be suppressed. In other words, even if the responsiveness of the above servo mechanism is increased, momentary incapability of the above-mentioned rotational position control is prevented.

Furthermore, in the rotary actuator 1, the cylinder 12 is assembled by the plurality of cylinder blocks 27 being put together in the axial direction of the cylinder 12, and the piston chambers 24 (24*a*, 24*b*) are defined between adjacent cylinder blocks 27. Therefore, when the piston chambers 24 (24*a*, 24*b*) are formed, a semicircular groove is formed on each cylinder block 27, and these grooves are combined to constitute the piston chambers 24 (24*a*, 24*b*). It is thus possible to readily form the piston chambers 24 (24*a*, 24*b*) for housing the arc pistons (14*a*, 14*b*) that slide and are displaced in the circumferential direction of the cylinder 12, and to readily manufacture the cylinder 12.

Further, with the rotary actuator 1, when the pressure oil is supplied to the second pressure chambers (26*a*, 26*b*), the pressure oil is also supplied to the third pressure chambers (35*a*, 35*b*) provided on the both ends in the axial direction of the cylinder 12, and the cylinder 12 is biased. Therefore, a biasing force generated due to an action of the pressure oil supplied to the third pressure chambers (35*a*, 35*b*) acts to bias adjacent cylinder blocks 27 in the axial direction of the cylinder 12, against an action of the pressure oil supplied to the second pressure chambers (26*a*, 26*b*). In other words, due to the biasing force generated due to the action of the pressure oil supplied to the third pressure chambers (35*a*, 35*b*), the plurality of cylinder blocks 27 are biased in a direction in which the cylinder blocks 27 are pressed against one another in the axial direction of the cylinder 12. Consequently, even if the case 11 is elastically deformed in the axial direction of the cylinder 12 due to the action of the supplied pressure oil, close contact between adjacent cylinder blocks 27 that define the piston chambers 24 (24*a*, 24*b*) can be readily maintained.

Furthermore, with the rotary actuator 1, regarding the cross-sectional area in the axial direction of the cylinder 12, the cross-sectional area of each third pressure chamber (35*a*, 35*b*) is set to be larger than the cross-sectional area of each second pressure chamber (26*a*, 26*b*). Therefore, in the axial direction of the cylinder 12, the magnitude of the biasing force generated due to the action of the pressure oil supplied to the third pressure chambers (35*a*, 35*b*) can be set to be larger than the magnitude of the biasing force generated due to the action of the pressure oil supplied to the second pressure chambers (26*a*, 26*b*). Consequently, close contact between adjacent cylinder blocks 27 that define the piston chambers 24 (24*a*, 24*b*) can be reliably maintained.

Furthermore, with the rotary actuator 1, the third pressure chambers (35*a*, 35*b*) can be readily configured with a simple structure by installing the pressure chamber defining members (16*a*, 16*b*) on both sides in the axial direction of the cylinder 12 inside the case 11.

Moreover, in the rotary actuator 1, the output shaft 13 is driven via the arms (15*a*, 15*b*) by the plurality of piston units 14 that are arranged in line along the axial direction of the output shaft 13. Therefore, it is possible to output a further large amount of driving torque with a compact structure, without increasing the dimension in the radial direction of the cylinder 12.

Furthermore, in the rotary actuator 1, the output shaft 13 can be driven to rotate by the arc pistons (14*a*, 14*b*) in the piston units 14 installed along the same plane perpendicular to the axial direction of the output shaft 13. Therefore, it is possible to output a lager amount of driving torque while preventing the rotary actuator 1 from becoming longer in the axial direction of the cylinder 12, and also preventing the rotary actuator 1 from becoming larger in the radial direction of the cylinder 12. In the case where each piston unit 14 is constituted by two arc pistons (14*a*, 14*b*) as in the present embodiment, it is possible to double the output of the rotary actuator 1 without increasing its length in the axial direction and the size in the radial direction.

Modifications

Although the embodiments of the present invention have been described thus far, the present invention is not limited to the embodiments described above, and various modifications may be made within the scope recited in the claims. For example, the present invention modified as below may be implemented.

(1) Although the above embodiment has been described, taking, as an example, a mode in which the third pressure chambers are provided on both sides in the axial direction of the cylinder, this need not be the case. A mode may be implemented in which the third pressure chamber is provided only one of the both sides in the axial direction of the cylinder.

(2) Although the above embodiment has been described, taking, as an example, a mode of the rotary actuator in which the plurality of piston units are installed in line along the axial direction of the output shaft, this need not be the case. A rotary actuator in a mode may be implemented in which only one piston unit is provided that is configured as a plurality of pistons installed along the same plane perpendicular to the axial direction of the output shaft so as to extend in the circumferential direction of the cylinder.

(3) Although the above embodiment has been described, taking, as an example, a mode in which the pressure chamber defining members are pressed against the ends of the cylinder by the ring nuts and thus fixed to the case, this need not be the case. For example, a mode may be implemented in which the pressure chamber defining members are directly fixed to the case. Alternatively, another mode may be implemented in which the pressure chamber defining members are fixed to the case by a fixing mechanism other than the ring nuts. Alternatively, still another mode may be implemented in which the pressure chamber defining members are not provided and the third pressure chambers are defined between a case bottom portion integrated with the case and the cylinder.

(4) The shape of the arm, the number of the installed arms, and the installation position are not limited to those in the mode taken as an example in the above embodiment, and may be modified in various ways for implementation. For example, the above-described embodiment has been described, taking, as an example, a mode in which two arms are provided that extend in the radial direction of the cylinder along the same plane perpendicular to the axial direction of the output shaft. However, this need not be the case. For example, a mode may be implemented that is provided with a single arm or three or more arms extending in the radial direction of the cylinder along the same plane perpendicular to the axial direction of the output shaft.

Furthermore, although the above embodiment has been described, taking, as an example, a mode in which the plurality of arms are arranged in line along the axial direction of the output shaft and extend parallel to each other, this need not be the case. For example, a configuration may alternatively be implemented in which a unitary plate-like arm extending along the axial direction of the output shaft is provided, and the plurality of pistons are rotatably connected to this plate-like arm. In this case, a plurality of slit-like spaces may be formed in the plate-like arm, and ends of the pistons may be rotatably connected to the respective spaces. Furthermore, in this case, the plurality of pitons may be rotatably connected to the arm by the same columnar pin members extending parallel to the axial direction of the output shaft.

Note that the mode of the arms extending in the radial direction of the cylinder from the plurality of positions on the output shaft is not limited to the mode described as an example in the above embodiment, and may be modified in various ways for implementation. In the case where the arms are provided so as to extend radially from the plurality of positions on the output shaft and thus the plurality of pistons are installed for driving, via the arms, the output shaft to rotate, the design associated with the installation positions thereof can be made more freely.

The present invention can be applied widely to rotary actuators that output a driving torque as a result of output shafts thereof pivoting in a rotational direction due to an action of a pressure medium. The present invention is not limited to the above-described embodiments, and all modifications, applications and equivalents thereof that fall within the claims, for which modifications and applications would become apparent by reading and understanding the present specification, are intended to be embraced therein.

What is claimed is:

1. A rotary actuator that outputs a driving torque as a result of an output shaft pivoting in a rotational direction due to an action of a pressure medium, comprising:

a case;

a cylinder that is installed within the case and internally has a hollow space;

an output shaft that is rotatably supported with respect to the case, has an axial direction parallel to an axial direction of the cylinder, and is installed in the hollow space;

an arm that is integrated with, or fixed to, the output shaft, and extends in a radial direction of the cylinder; and a piston that has a portion extending in an arc, and is installed inside the cylinder and supported so as to be able to slide and be displaced with respect to the cylinder along a circumferential direction of the cylinder, wherein the cylinder has a plurality of cylinder blocks formed in a divided state, and the cylinder is integrally assembled by the plurality of cylinder blocks being put together along the axial direction of the cylinder, inside the cylinder, a first pressure chamber in which the output shaft and the arm are housed and a second pressure chamber that is defined by the cylinder and the piston and to which a piston head portion provided at one end of the piston is opposed are provided, the cylinder is provided with a piston chamber that houses the piston supported so as to be able to slide and be displaced with respect to the cylinder and that defines the second pressure chamber, between cylinder blocks that are adjacent to each other in the axial direction of the cylinder, the piston is provided with a connecting portion that is rotatably connected to the arm at an end that is opposite to the one end, inside the case, a third pressure chamber that is in communication with the second pressure chamber is provided on at least one of both sides of the cylinder in the axial direction of the cylinder, as a result of the pressure medium being supplied to one of the first pressure chamber and the second pressure chamber and discharged from the other of the first pressure chamber and the second pressure chamber, the arm is displaced in the circumferential direction of the cylinder, and the output shaft pivots in the rotational direction, and when the pressure medium is supplied to the second pressure chamber, the pressure medium is also supplied to the third pressure chamber, and the cylinder is biased due to the action of the pressure medium.

2. The rotary actuator according to claim 1, wherein an area of a cross-section of the third pressure chamber that is perpendicular to the axial direction of the cylinder is larger than, or the same as, an area of a cross-section of the second pressure chamber that is perpendicular to the axial direction of the cylinder and at a position of a fitting face of cylinder blocks that are adjacent to each other.

3. The rotary actuator according to claim 1, further comprising a pressure chamber defining member that is installed inside the case on at least one of both sides of the cylinder in the axial direction of the cylinder, defines the third pressure chamber between the pressure chamber defining member and the cylinder, and is fixed to the case in a state of being in close contact with an inner circumference of the case.

4. The rotary actuator according to claim 1, wherein a plurality of the pistons are provided, and the plurality of pistons are arranged in line along an axial direction of the output shaft.

5. The rotary actuator according to claim 1, wherein a plurality of the arms are provided so as to extend in the radial direction of the cylinder from a plurality of positions on the output shaft.

6. The rotary actuator according to claim 5, wherein the plurality of arms are provided to extend in the radial direction of the cylinder along the same plane that is perpendicular to the axial direction of the output shaft, a piston unit is provided that is constituted by the plurality of pistons installed so as to extend in the circumferential direction of the cylinder along the same plane, and the pistons in the piston unit are rotatably connected to the respective arms.

7. The rotary actuator according to claim 6, wherein a plurality of the piston units are provided, and the plurality of piston units are arranged in line along the axial direction of the output shaft.

* * * * *